US008827504B2

(12) United States Patent
Parker et al.

(10) Patent No.: US 8,827,504 B2
(45) Date of Patent: Sep. 9, 2014

(54) LIGHT BULB USING SOLID-STATE LIGHT SOURCES

(75) Inventors: Jeffery R. Parker, Richfield, OH (US); Timothy A. McCollum, Avon Lake, OH (US); Robert M. Ezell, Brunswick, OH (US); Witold Bauer, Westlake, OH (US)

(73) Assignee: Rambus Delaware LLC, Brecksville, OH (US)

( * ) Notice: Subject to any disclaimer, the term of this patent is extended or adjusted under 35 U.S.C. 154(b) by 669 days.

(21) Appl. No.: 13/075,373

(22) Filed: Mar. 30, 2011

(65) Prior Publication Data

US 2011/0309735 A1 Dec. 22, 2011

Related U.S. Application Data

(60) Provisional application No. 61/356,533, filed on Jun. 18, 2010.

(51) Int. Cl.
*H01J 7/24* (2006.01)
*F21K 99/00* (2010.01)

(52) U.S. Cl.
CPC ..... *F21K 9/135* (2013.01)
USPC ..... 362/341; 362/249.14; 362/297; 362/307

(58) Field of Classification Search
CPC ..... F21K 9/135; F21K 9/52
USPC ..... 362/341, 249.14, 297, 307
See application file for complete search history.

(56) References Cited

U.S. PATENT DOCUMENTS

| | | | |
|---|---|---|---|
| 6,840,655 | B2 | 1/2005 | Shen |
| 7,092,612 | B1 | 8/2006 | Coushaine |
| 7,144,135 | B2 | 12/2006 | Martin et al. |
| 7,273,300 | B2 | 9/2007 | Mrakovich |
| 7,658,514 | B2 | 2/2010 | Lee et al. |
| 7,909,481 | B1 | 3/2011 | Zhang et al. |
| 2009/0251892 | A1 | 10/2009 | Hatti et al. |
| 2010/0026185 | A1 | 2/2010 | Betsuda et al. |
| 2010/0027270 | A1 | 2/2010 | Huang et al. |
| 2010/0060130 | A1 | 3/2010 | Li |
| 2010/0073944 | A1 | 3/2010 | Chen |
| 2010/0103666 | A1 | 4/2010 | Chang et al. |
| 2011/0032708 | A1 | 2/2011 | Johnston et al. |
| 2011/0037387 | A1 | 2/2011 | Chou et al. |
| 2011/0090686 | A1 | 4/2011 | Pickard |
| 2011/0234076 | A1 | 9/2011 | Simon et al. |

FOREIGN PATENT DOCUMENTS

| | | |
|---|---|---|
| JP | 2010086709 | 4/2010 |

OTHER PUBLICATIONS

International Search Report in International Application No. PCT/US2011/037676 dated Feb. 9, 2012 (9 pages) (enclosed).

*Primary Examiner* — Elmito Breval
(74) *Attorney, Agent, or Firm* — Renner, Otto, Boisselle & Sklar, LLP

(57) ABSTRACT

A light bulb has a light guide configured as a hollow body surrounding an internal volume. The light guide is open at its proximal and distal ends, and has inner and outer surfaces and an end surface at the proximal end that provides a light input edge. A solid-state light source is optically coupled to the light input edge of the light guide such that light from the solid-state light source travels in the light guide by total internal reflection. The solid-state light source is thermally coupled to a housing at the proximal end of the light guide. The housing contains vents for air flow and convection cooling through the internal volume. Light-extracting optical elements at least one of the inner surface and the outer surface of the light guide are for extracting light from the light guide.

60 Claims, 12 Drawing Sheets

LIGHT BULB USING SOLID-STATE LIGHT SOURCES

CROSS-REFERENCE TO RELATED APPLICATIONS

This application claims the benefit of U.S. Provisional Application No. 61/356,533, filed Jun. 18, 2010, the entire disclosure of which is incorporated herein by reference.

BACKGROUND

Light emitting diode (LED) based light bulbs or light fixtures are generally known. These devices use high power LEDs or clusters of lower power LEDs in conjunction with reflectors, lenses and diffusers to produce either an illuminated spot or a diffuse light output distribution. These devices are generally closed "bulbs" which require the light from the LEDs to undergo multiple reflections or scattering events before the light exits the devices through a scattering or clear plate. Each time the light interacts with one of these surfaces, the optical efficiency of the devices is reduced due to absorption of light or light being scattered at unusable angles. In general these devices are limited in the optical effects that can be produced (spot focusing or diffuse scattering).

In addition, these devices have difficulty in dissipating the heat generated by the LED light sources. Due to the closed nature of the devices, heat can be trapped and built up within the closed volume of the devices. The difficulty in removing heat from these devices limits the brightness of the illumination that can be achieved for a given electrical input power because, as the temperature of the LED light sources increases, the efficacy of the LED light sources is reduced.

To remove as much heat as possible, large heat sinks can be required to provide increased surface area for thermal radiation and convection. In many applications, however, the maximum acceptable size of the devices is limited. For example, an LED-based incandescent light bulb replacement should have a size and shape within the size and shape specified for standard incandescent light bulbs. In these size-restricted cases, the volume taken up by the heat sinks reduces the available area to mount additional LED light sources. This produces a limit on the number of LED light sources that can be used in such a device and thus limits the brightness that can be achieved.

DETAILED DESCRIPTION

Figure 1A:
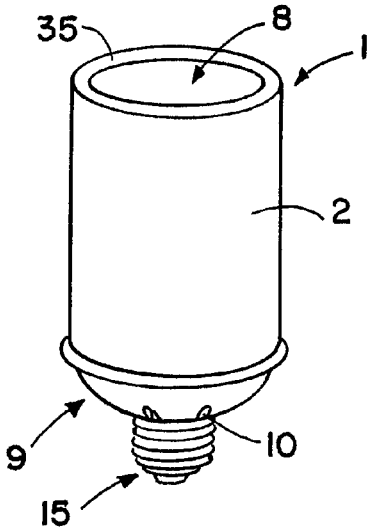
FIG. 1*a* is a schematic perspective view of one light bulb embodiment.
Figure 2:
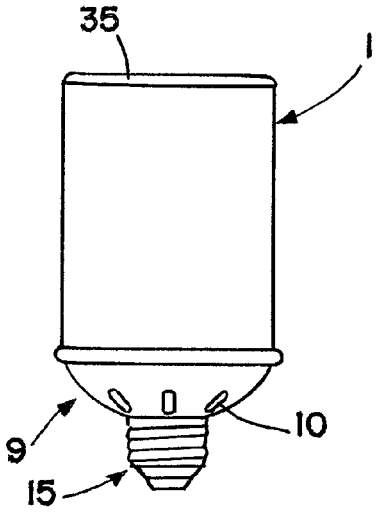
FIG. 2 is a schematic side view of the light bulb of FIG. 1*a*.
Figure 3:
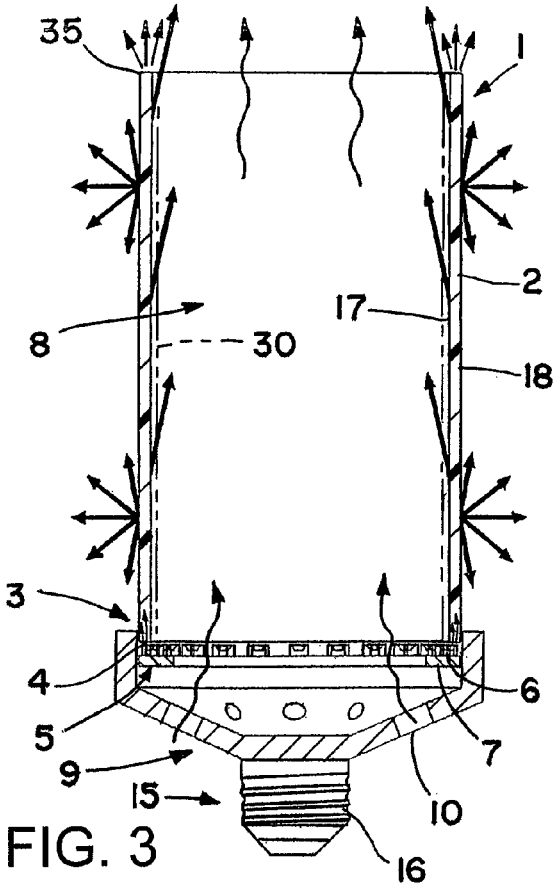
FIG. 3 is an enlarged schematic longitudinal section through the light bulb of FIGS. 1*a* and 2.

Referring now in detail to the drawings, and initially to FIGS. 1*a*, 2 and 3, there is schematically shown an example of a light bulb embodiment 1. References in this disclosure to a "light bulb" are meant to broadly encompass light-producing devices that fit into and engage any of various fixtures used for mechanically mounting the light-producing device and for providing electrical power thereto. Examples of such fixtures include, without limitation, screw-in fixtures for engaging an Edison light bulb base, a bayonet fixture for engaging a bayonet light bulb base, and a bi-pin fixture for engaging a bi-pin light bulb base. Thus the term "light bulb," by itself, does not provide any limitation on the shape of the light-producing device, or the mechanism by which light is produced from electric power. Also, the light bulb need not have an enclosed envelope forming an environment for light generation. The light bulb may conform to American National Standards Institute (ANSI) or other standards for electric lamps, but the light bulb does not necessarily have to have this conformance.

The example shown in FIGS. 1*a*, 2 and 3 comprises a non-planar optically-conductive light guide 2 open at opposite ends. In the example shown, light guide 2 is cylindrical in shape. The end surface at one end 3 of the light guide (the proximal end) provides a light input edge 4 to which a solid-state light source 5 is optically coupled (see FIG. 3). In the example shown, the solid-state light source 5 comprises solid-state light emitters mounted on a printed circuit board 7. The printed circuit board 7 is typically heat conducting. An exemplary solid-state light emitter is shown at 6. Reference numeral 6 will also be used to refer to the solid-state light emitters collectively. The solid-state light emitters 6 are arranged such that light from the solid-state light emitters enters the light input edge 4 at the proximal end of the light guide and travels in the light guide by total internal reflection. The solid-state light emitters 6 are arranged in a ring or another suitable pattern depending on the shape of the light input edge of the light guide to which the solid-state light emitters are optically coupled. The solid-state light emitters are typically coupled to the light guide in a manner that increases the efficiency with which the light output by the solid-state light emitters enters the light guide. In some examples, the solid-state light emitters are potted, bonded or integral with the light guide.

In some examples, the light input edge 4 of the light guide 2 includes micro-optical elements to change the directional characteristics of the light entering the light guide 2. For purposes of this disclosure, any surface of the light guide 2 through which light from the light source 5 enters the light guide is considered a light input edge, even if it is located on one of the major surfaces of the light guide, or forms part of a light turning and/or homogenizing structure to introduce light into the light guide in a manner that allows the light to propagate along the light guide 2 by total internal reflection at the major surfaces of the light guide.

Examples of solid-state light emitters 6 include light-emitting diodes (LEDs), laser diodes, and organic LEDs (OLEDs). The solid-state light emitters may have a top-fire or a side-fire configuration. The solid-state light sources may be broad spectrum solid-state light sources (e.g., emit white light) or solid-state light sources that emit light of a desired color or spectrum (e.g., red light, green light, blue light, or ultraviolet light). In some embodiments, the solid-state light emitters 6 emit light with no operably-effective intensity at wavelengths greater than 500 nanometers (nm) (i.e., the solid-state light emitters emit light at wavelengths that are predominantly less than 500 nm).

In this embodiment, light guide 2 has a hollow cylindrical shape with a nominally constant radius along its length and surrounds internal volume 8. Light guide 2 is supported at its proximal end by a housing 9. In some examples, housing 9 additionally positions and aligns the solid-state light source 5 relative to the light input edge 4 of the light guide. Optionally, the solid-state light emitters 6 are positioned in respective openings (not shown) defined in the light guide. In various embodiments, each light-emitter opening is configured as a slot extending into the light guide from its proximal end, a cavity extending into the light guide from its proximal end, a hole extending through the light guide between the major inner and outer surfaces thereof, or another suitable shape. Other configurations of the light-emitter openings are possible and may be used.

The solid-state light source 5 is thermally coupled to the housing 9. In an example, such thermal coupling is provided by direct contact between the solid-state light source and the housing. In another example, thermal coupling is provided by using a secondary device, such as a heat pipe, to convey heat produced by the solid-state light source to the housing. In other examples, thermal contact between the solid-state light source 5 and the housing 9 is enhanced by the use of a thermal coupling agent, such as a thermal adhesive, thermal grease, thermal contact pads, and the like.

In typical embodiments, housing 9 is shaped to provide an increased surface area available for cooling. In an example, housing 9 is constructed partially or fully out of cooling fins. In another example, housing 9 is cast to provide cooling fins.

Vents 10 extend through housing 9 to provide a path for air flow and convection cooling into the internal volume 8 of the light guide as further schematically shown in FIG. 3. In some embodiments, holes or slots defined in the housing provide the vents. In some embodiments, the spacing between the cooling fins provides the vents. Optionally, a fan may be provided in the housing or internal volume for increasing the air flow through the vents.

A suitable electrical connection 15 is provided to supply electrical power to the solid-state light source 5. Typically, the electrical connection is mechanically coupled to the housing 9 and is electrically insulated therefrom. In an example, the electrical connection is provided by a base 16 coupled to the housing. Examples of bases include an Edison screw base, a bayonet base, or a bi-pin base. The structures described herein may also be used in lighting assemblies other than light bulbs. In lighting assemblies, the electrical connection may be provided by a base, using a wire that extends through the housing, or by some other suitable electrical connection.

Optionally, the light bulb may be provided with a power control circuit (not shown) including a temperature sensor (not shown) for sensing the internal temperature of the light bulb. If the sensed temperature reaches a predetermined high level, the power control circuit may either reduce the current to the solid-state light source or completely cut off power to the solid-state light source. Also the light bulb may include an orientation sensor that causes an alarm to go off and prevents the solid-state light source from turning on if the light bulb is improperly installed, or installed in an orientation that inhibits proper convective air flow.

Figure 4:
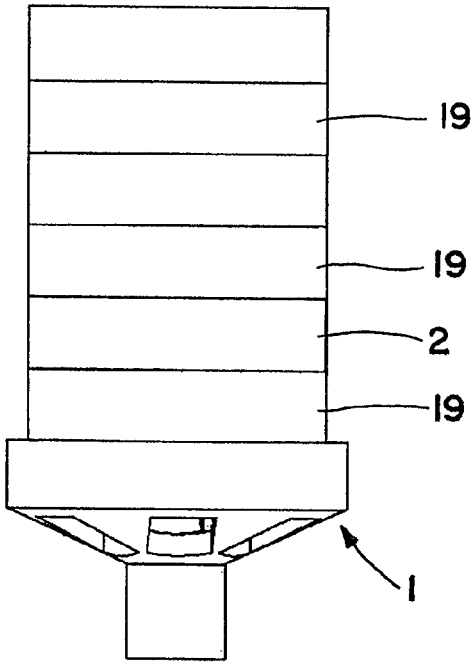
FIG. 4 is another schematic side view of the light bulb of FIG. 1*a*.
Figure 6:
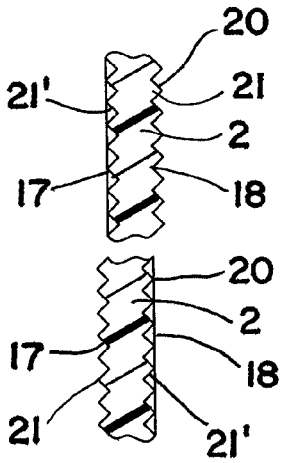
FIG. 6 is an enlarged schematic fragmentary longitudinal section of a portion of the light guide of the light bulb of FIG. 3 showing light-extracting optical elements at the inner and outer surfaces of the light guide.

The light guide 2 has a major inner surface 17 facing toward the internal volume and a major outer surface 18 facing away from the internal volume. Light-extracting optical elements (not shown) are located in one or more defined areas of at least one of the inner surface 17 and the outer surface 18 of light guide 2. The light-extracting optical elements are configured to extract light from the light guide with a predetermined light ray angle distribution and/or intensity profile. Intensity profile refers to the variation of intensity with position in a light-emitter such as light guide 2. Light ray angle distribution refers to the variation of intensity with ray angle (typically a solid angle) of light emitted from a light emitter such as light guide 2. An example of defined areas is shown in FIG. 4, where the light-extracting optical elements are located in circumferential bands 19 arrayed along one or both of the inner and outer surfaces 17 and 18 of the light guide. In some embodiments, the light-extracting optical elements 20 at a given surface 17, 18 in a defined area are protrusions 21 from such surface as schematically shown in FIG. 6. In other embodiments, the light-extracting optical elements 20 at such surface are indentations 21' in such surface as further shown in FIG. 6. In other embodiments, some of the light-extracting optical elements at such surface are protrusions and others of the light-extracting optical elements are indentations. Also different types or shapes of light-extracting optical elements may be provided in defined areas of one or both surfaces of the light guide. Such areas of the surfaces 17, 18 may also contain a combination of one or more different types of light-extracting optical elements in fixed or varying proportions, with each type providing a different optical effect that contributes to the overall light ray angle distribution and intensity profile of the light output by the light bulb.

Figure 5:
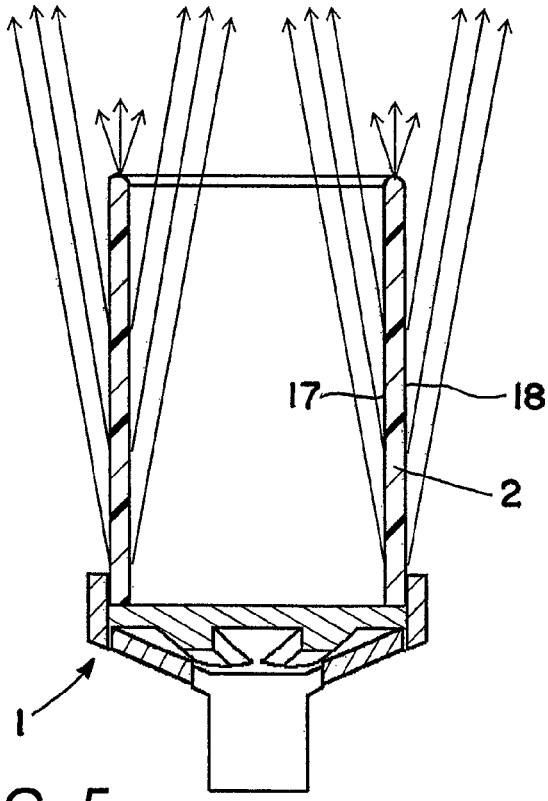
FIG. 5 is another schematic longitudinal section through the light bulb of FIGS. 1*a* and 2.

By way of example, a first type of light-extracting optical element is configured to extract light from the outer surface 18 of the light guide 2 to provide a broad light ray angle distribution, and a second type of light-extracting element is configured to extract light from and at low ray angles relative to the inner surface 17 of the light guide 2 to provide a narrower light ray angle distribution, as shown in FIG. 3. The sum of these two distributions provides an overall light ray angle distribution that possesses both diffuse and directional components. In an alternate configuration one type of optical element may be configured to provide both the broad light ray angle distribution from the outer surface 18 and the narrower light ray angle distribution from the inner surface 17 of the light guide 2. In another example shown in FIG. 5, light-extracting optical elements are configured to extract light from the light guide 2 at low ray angles relative to the inner surface 17 and the outer surface 18 of the light guide 2. The sum of these two distributions provides an overall light ray angle distribution that is more directional and narrower than that of the above-described narrower light ray angle distribution.

Many types and shapes (and/or more than one type and shape) of light-extracting optical elements may be provided at one or both surfaces of the light guide, including, for example, the types and shapes of light-extracting optical elements disclosed in U.S. Pat. No. 6,712,481, the entire disclosure of which is incorporated herein by reference. Also, the light-extracting optical elements at least one of the surfaces of the light guide may be designed to produce other light output distributions, including, for example, an image or other effect. In another example, the light-extracting optical elements are configured to project an illumination pattern onto a nearby surface. Further, a reflective element 30 may be provided adjacent to the inner surface of the light guide as schematically shown in phantom lines in FIG. 3 for reflecting light back out through the outer surface of the light guide. Either a diffuse or specular reflective element may be used to provide desired light ray angle distribution. In an example, reflective element 30 is provided by a discrete cylindrical reflector mounted inside the light guide. In another example, reflective element 30 is provided by a reflective coating applied to the inner surface of the light guide.

Light guide 2 may be comprised of a single optical material which may be rigid or flexible or be comprised of multiple layers of materials of different indices of refraction and may optionally contain light-extracting optical elements at the surface of one of the layers adjacent another of the layers. Also, the light guide may contain particles with different indices of refraction than that of the light guide and/or may contain voids for scattering or redirecting light. Additionally or alternatively, the light guide may contain a wavelength-shifting material for altering the spectrum of the emitted light. A wavelength-shifting material, as used in this disclosure, is a material that absorbs light at certain wavelengths, and reemits the light at one or more different wavelengths. Examples of a wavelength-shifting material include a phosphor material, a luminescent material, a luminescent nanomaterial such as a quantum dot material, a conjugated polymer material, an organic fluorescent dye, an organic phosphorescent dye, lanthanide-doped garnet, or another suitable wavelength-shifting material.

Figure 7:
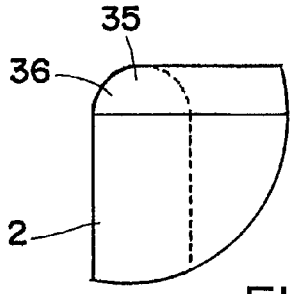
FIGS. 7-10, 11*a* and 11*b* are enlarged schematic fragmentary side views of different shaped distal end portions of the light guide portion of the light bulb that provide different lighting effects for different lighting applications.
Figure 8:
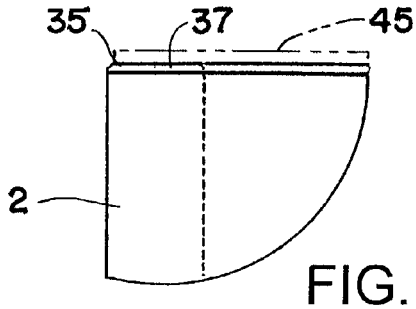
Figure 9:
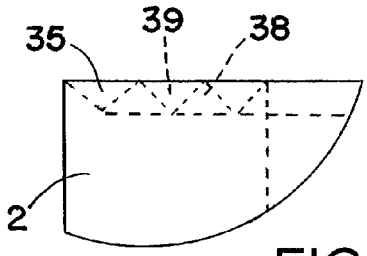
Figure 10:
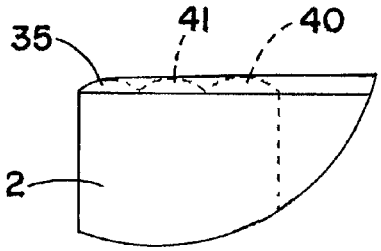
Figure 11A:
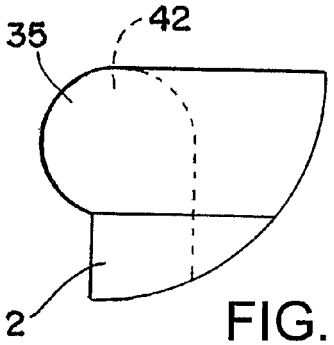
Figure 11B:
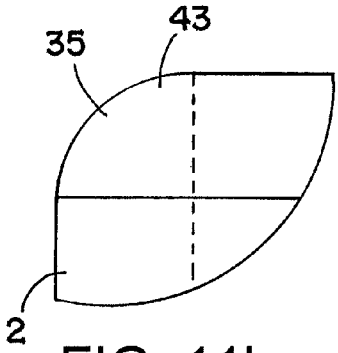

Different optical end features may also be provided at the distal end 35 of the light guide (the end opposite the light input edge) to increase the light output efficiency of the light guide and/or produce a desired optical effect. For example, FIG. 7 shows a rounded end feature 36 configured to broaden the light ray angle distribution of the light emitted from the distal end 35 of the light guide; FIG. 8 shows a flat end feature 37; FIG. 9 shows an end feature 38 having one or more V-grooves 39 concentric with the light guide to redirect the light in various directions in accordance with the shape and orientation of the V-grooves; FIG. 10 shows an end feature 40 composed of one or more lenticular grooves 41 concentric with the light guide to redirect the light in accordance with the shape and orientation of the lenticular grooves 41; FIG. 11*a* shows a bulbous end feature 42 that tends to broaden the light ray angle distribution and also redirect the light radially outward or inward depending on the bulbous shape; and FIG. 11*b* shows a bullnose end feature 43 to direct a portion of the light outward or inward depending on the orientation of the bullnose feature.

In addition to or in lieu of providing different optical features at the distal end 35 of the light guide, a light-reflecting or light-absorbing end feature 45 may be provided at the distal end 35 of the light guide as schematically shown in FIG. 8. By way of example, a light-reflecting end feature may be a metallic coating, a dielectric stack, or a white pigment coating used to reflect light back into the light guide for extraction therefrom by the light-extracting optical elements at the inner and the outer surfaces of the light guide, whereas a light-absorbing end feature may include a light-absorbing coating such as a black coating that absorbs light.

In other examples, the end feature 45 is an antireflection coating that reduces the fraction of the light incident on the distal end 35 of the light guide 2 that is reflected back into the light guide. In another example, the end feature 45 includes a color attenuator to modify the spectrum of the light emitted from the distal end of the light guide relative to that of the light emitted from the surfaces 17 and 18 of the light guide, or to cause light of an array of spectra to be emitted from the distal end of the light guide. In another example, the end feature 45 includes color-attenuating regions to cause light of different spectra to be emitted from the distal end of the light guide. Color attenuating refers to the attenuating light of one or more wavelengths more than light of other wavelengths. In another example, the end feature 45 comprises a wavelength-shifting material, as described above, for altering the spectrum of the light emitted from the distal end 35 of the light guide 2.

Figure 1B:
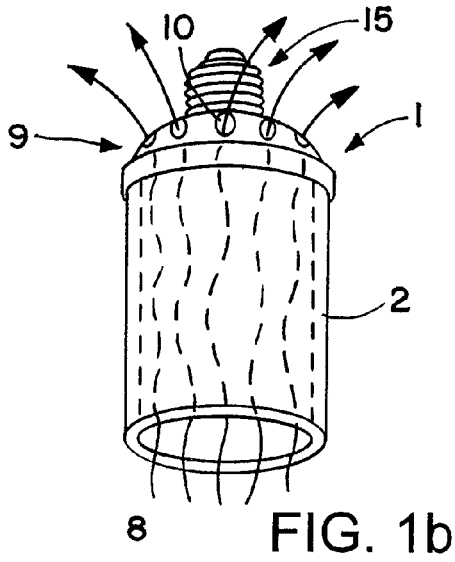
FIG. 1*b* is a schematic perspective view of the light bulb of FIG. 1*a* inverted.

FIG. 1*b* shows the light bulb 1 of FIGS. 1*a*, 2 and 3 inverted to illustrate the air flow and convection cooling through the internal volume 8 of the light guide 2 and vents 10 defined in the housing 9 in the opposite direction to that shown in FIG. 3. The cooling air flow reverses when light bulb 1 is mounted with the orientation shown in FIG. 1*a*, such that cool air enters the light bulb through vents 10 in housing 9 and warm air exits the light bulb through the open, distal end of light guide 2.

Figure 12:
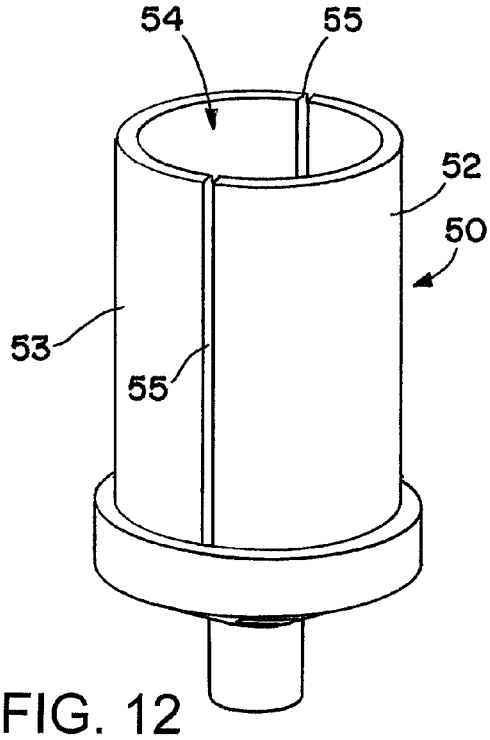
FIG. 12 is a schematic perspective view of another light bulb embodiment.

FIG. 12 shows an example of another light bulb embodiment 50. The example of light bulb shown in FIG. 12 is substantially similar to the embodiment shown in FIGS. 1*a*, 1*b*, 2 and 3 except that two non-planar light guide members 52 and 53 form a light guide configured as a hollow body that surrounds the internal volume 54. In the example shown in FIG. 12, gaps 55 are provided between adjacent side edges of the light guide members 52 and 53 to allow for air flow through the gaps. In another example, the adjacent side edges of the light guide members are in close abutting engagement and may be bonded to one another.

Figure 13:
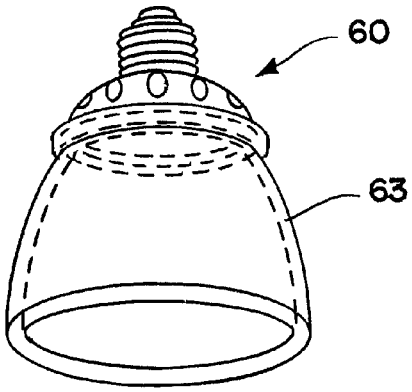
FIGS. 13 and 14 are schematic perspective views of other light bulb embodiments.
Figure 14:
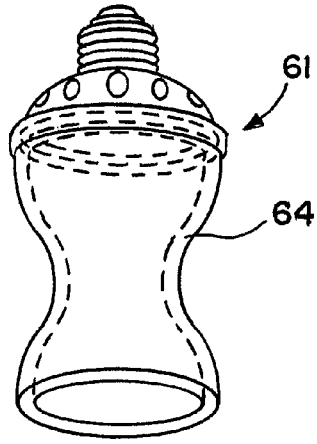
Figure 15:
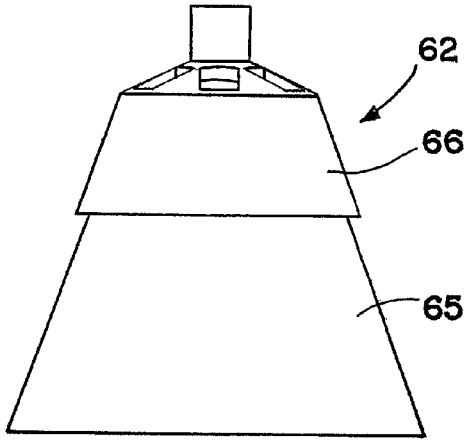
FIG. 15 is a schematic side view of another light bulb embodiment.

FIGS. 13-15 show examples of other light bulb embodiments 60, 61 and 62. The examples of light bulb embodiments 60, 61 and 62 are substantially similar to the embodiments described above, but have light guides that differ in shape from the cylindrical light guide shown for example in FIGS. 1*a* and 2. The shape of the light guide is a parameter that, in addition to the configuration of the light-extracting optical elements at one or both of the surfaces of the light guide, can be varied to define the light ray angle distribution of the light emitted from the light bulb. FIG. 13 shows a bell-shaped light guide 63; FIG. 14 shows an hourglass shaped light guide 64; and FIG. 15 shows a light guide 65 in the shape of a truncated cone having a cross-sectional diameter that increases with increased distance from the proximal end toward the distal end of the light guide. In the example shown in FIG. 15, a portion of the housing 66 of the light bulb 62 covers a greater portion of the outer surface of the proximal end of the light guide 65 than in other embodiments, and the inner surface of the portion of the housing 66 juxtaposed with the light guide comprises a reflector (not shown).

Figure 16:
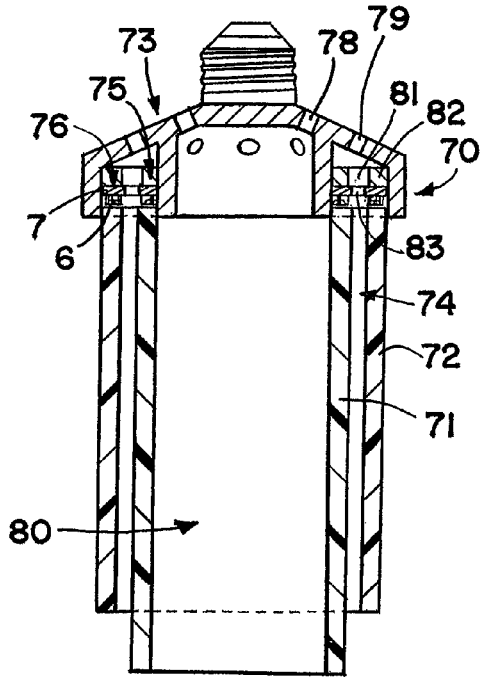
FIGS. 16 and 18-23 are schematic partial longitudinal sections through other light bulb embodiments.

FIG. 16 shows an example of another light bulb embodiment 70 comprising two coaxial hollow inner and outer light guides 71 and 72. In the example shown in FIG. 16, light guides 71 and 72 are cylindrical. Light guides 71 and 72 are supported at their proximal ends by a housing 73 with inner light guide 71 located inside outer light guide 72 with an air gap 74 between the light guides. The light guides may be of the same length, or may have different lengths as in the example shown in FIG. 16. Separate solid-state light sources 75 and 76 are optically coupled to a light input edge at the proximal end of each of the light guides. Alternatively, a single solid-state light source can be optically coupled to the light input edges of both light guides.

The solid-state light sources 75 and 76 are thermally coupled to the housing 73 to dissipate heat produced by the solid-state light emitters. In addition, the solid-state light emitters of the respective solid-state light sources may generate light of different colors, different shades of color (including shades of white) and/or different intensities, to cause light of the same or different colors to be emitted from the inner and outer light guides.

The solid-state light emitters of the solid-state light sources 75 and 76 may also be separately controlled by altering the current, voltage, pulse width, pulse frequency, pulse duty cycle or pulse waveform to provide different lighting effects as desired. In an example, the solid-state light emitters of one light source may be selectively pulsed with different pulse frequencies to alert a person to an emergency. In another example, the duty cycle of the solid-state light emitters may be varied to change the amount of light emitted from one or both of the inner or outer light guides.

In some embodiments, each of the light guides 71 and 72 has light-extracting optical elements having different configurations at least one of the inner surface and the outer surface of each of the light guides for extracting light from each of the light guides in a predetermined light ray angle distribution and/or intensity profile. In an example, the light-extracting optical elements at least one surface of the outer light guide 72 is configured to cause light with a broad light ray angle distribution to be emitted radially outwardly from the outer light guide and the light-extracting optical elements at least one surface of the inner light guide 71 is configured to cause light to be emitted from the inner light guide with a narrower light ray angle distribution. Moreover, the distal end portion of at least one of the inner and outer light guides may be provided with different end features to produce different optical effects in the manner described above.

Sets of vents 78 and 79 are defined in the housing 73 to provide separate air paths for air flow and convection cooling through the internal volume 80 surrounded by the inner light guide 71 and through vents 81 in heat sink 82, air gap 83 between the light sources 75 and 76 and air gap 74 between the light guides 71 and 72. Heat sink 82 is in thermal contact with both the housing 73 and the light sources 75 and 76. In an alternate configuration the PCB 7 also serves as the heat sink 82.

FIGS. 17-23 show examples of other light bulb embodiments 84-90. The examples shown in FIGS. 17-23 are substantially similar to one or more of the light bulb embodiments described above but differ in that each of these examples includes an end cap positioned adjacent and at least partially covering the distal end of the respective light guide for redirecting at least a portion of the light emitted by the inner surface of the light guide in different directions as desired. The end cap can be clear, diffusive or reflective (including reflective regions) as desired.

Figure 17:
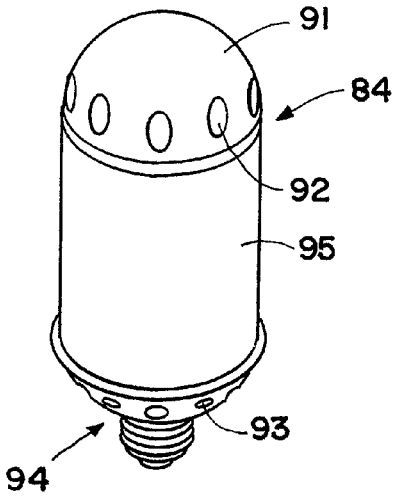
FIGS. 17 and 24 are schematic perspective views of other light bulb embodiments.

In the FIG. 17 embodiment, the end cap 91 is configured as a lens, which, while shown in FIG. 17 to be convex, could be concave or some other refractive shape if desired. Vents 92 in the end cap 91 as well as vents 93 in the housing 94 provide a path for air flow and convection cooling through the internal volume surrounded by the light guide 95 as before. In the example, holes or slots extending through end cap 91 provide the vents 92.

Figure 18:
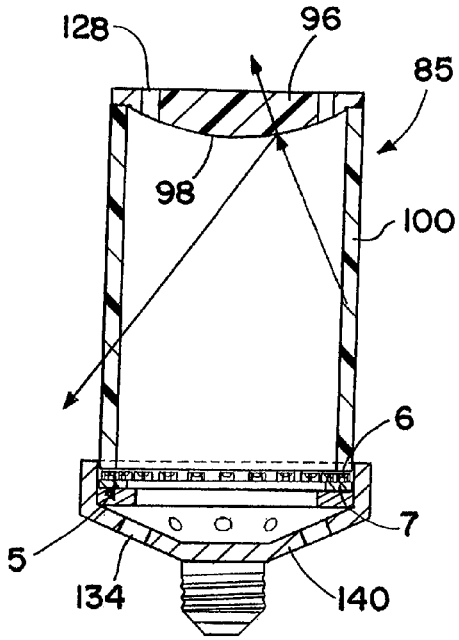
Figure 19:
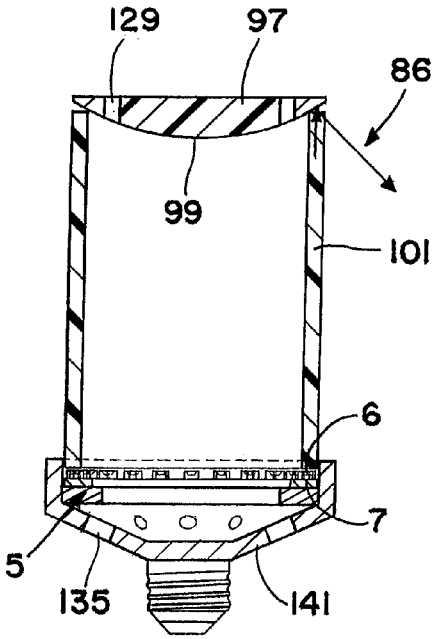
Figure 20:
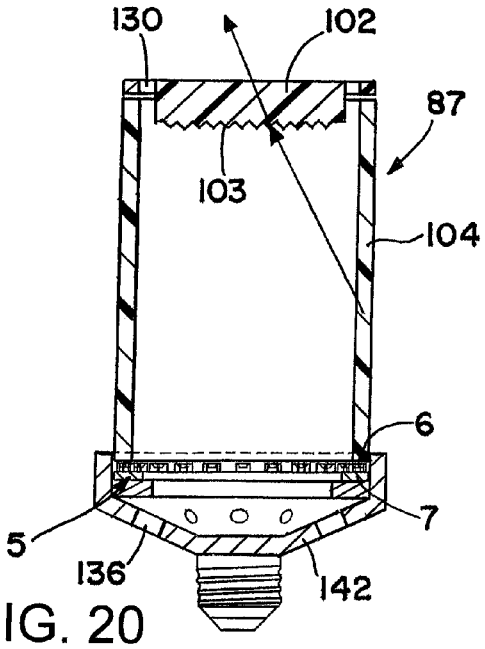

In the FIGS. 18 and 19 embodiments, the respective end caps comprise optical inserts 96 and 97 having a convex surface 98 and 99, respectively, shaped to redirect at least a portion of the light emitted from the inner surface of the respective light guides 100 and 101. The optical inserts redirect the light by one or both of reflection and refraction. FIG. 18 shows a portion of the light extracted from the inner surface of the light guide 100 being reflected back toward and through the light guide. The reflected light broadens the light ray angle distribution of the light output by the light bulb. Also FIG. 19 shows the convex surface 99 of the optical insert 97 extending radially outwardly in an overlying relation to the distal end of the light guide 101 to redirect light exiting from the distal end of the light guide. In the FIG. 20 embodiment, the end cap comprises an optical insert 102 in the shape of a Fresnel lens or lens array 103 for redirecting at least a portion of the light emitted by the inner surface of the light guide 104. Optionally, the end cap of one or more of these embodiments may comprise a reflector or reflective regions, or a diffuser or diffusive regions for redirecting or scattering at least a portion of the light emitted by the inner surface of the light guide. Also, the end cap may comprise a transreflector or one or more transreflective regions, a color attenuator or one or more color-attenuating regions or a wavelength-shifter or one or more wavelength-shifting regions.

Figure 21:
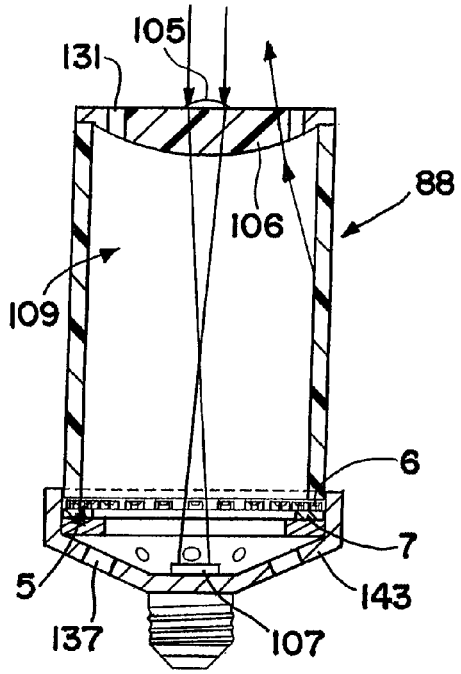

The example of a light bulb embodiment 88 shown in FIG. 21 is substantially similar to that shown in FIG. 18, but differs by the addition of a focusing region (for example a lens) 105 on the outer surface of the optical insert 106. Focusing region 105 focuses light originating outside the light bulb onto an optical sensor 107 shown located within the housing 143 below the internal volume 109, but that may be located wherever desired within the internal volume. Optical sensor 107 may comprise, for example, a CCD or CMOS image sensor, photodiode, photoresistor, motion sensor or other type of optical sensor. Focusing region 105 may be formed integrally with optical insert 106 or may be affixed to optical insert 106 using a suitable adhesive or mechanical fastening.

Figure 22:
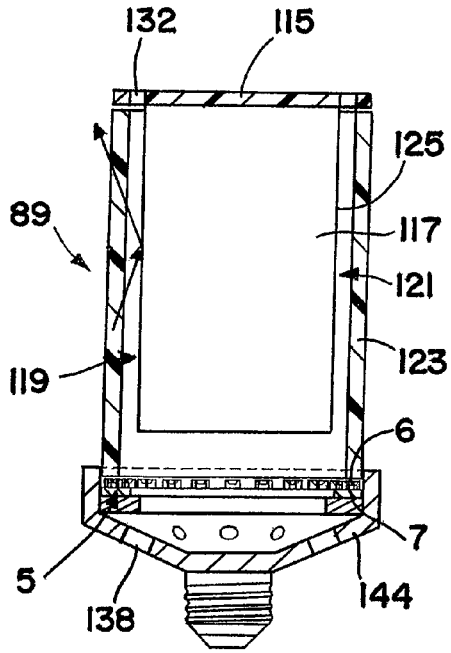
Figure 23:
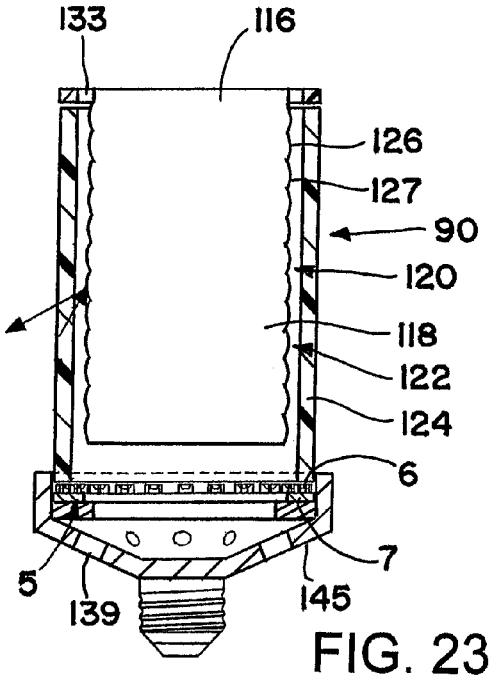

In the examples of light bulb embodiments 89 and 90 shown in FIGS. 22 and 23, the respective optical inserts 115 and 116 have extensions 117 and 118 that extend into the respective internal volumes 119 and 120 and occupy a substantial portion of the respective internal volumes. Extensions 117 and 118 are configured to leave air gaps 121 and 122 between the extensions and inner surface of the respective light guides 123 and 124. Also the extensions of the respective optical inserts may have substantially the same shape as the internal volumes or may differ in shape from the internal volumes, as desired. For example, the extensions may be in the shape of a truncated cone or pyramid that has a cross sectional area that decreases with increasing distance from the distal end toward the proximal end of the light guides. The extension 117 of the optical insert 115 is shown in FIG. 22 as having a substantially smooth exterior surface 125 for reflecting light emitted by the inner surface of the light guide 123 back into and through the light guide. The extension 118 of the optical insert 116 is shown in FIG. 23 as having optically-functional elements 126 at the exterior surface 127 of the extension 118 which may be of different types and shapes for redirecting light emitted by the inner surface of the light guide 124 in different directions in order to modify the emission characteristics of a standard hollow light guide by adding an appropriate insert. Examples of optically-functional elements include micro-optical elements, V-grooves, lenticular grooves, diffuse reflectors, specular reflectors, metal surfaces, light absorbers, color attenuators, wavelength shifters, dielectric stack reflectors, polarizers and transreflectors. Examples of wavelength-shifting materials used in wavelength shifters include a phosphor material, a luminescent material, a luminescent nanomaterial such as a quantum dot material, a conjugated polymer material, an organic fluorescent dye, and an organic phosphorescent dye.

Moreover, in all of the light bulb embodiment examples shown in FIGS. 18-23, suitable vents 128-133 may extend through the respective optical inserts to provide a path for air flow and convection cooling through vents 134-139 in the respective housings 140-145 and the internal volume of the respective light bulb in the manner previously described.

FIGS. 24-34 show examples of other light bulb embodiments. The examples shown in FIGS. 24-34 are substantially similar to one or more of the light bulb embodiments described above. However, each of these light bulb embodiments additionally includes an internal heat sink within the internal volume of the respective light guide. The internal heat sink is thermally coupled to the solid-state light source of the respective light bulb embodiment. The thermal coupling can be direct, via housing of the light bulb, or via another intermediate thermally-conductive element thereof. Thermally coupling the light source(s) to the internal heat sink increases the ability of the light bulb embodiment to dissipate the heat produced by the solid-state light source without reducing the available area that can be used for the solid-state light source and light guide. Also, as will be described below, the heat sink can be designed to function as an optical component in the light bulb embodiment to produce additional optical effects.

Figure 24:
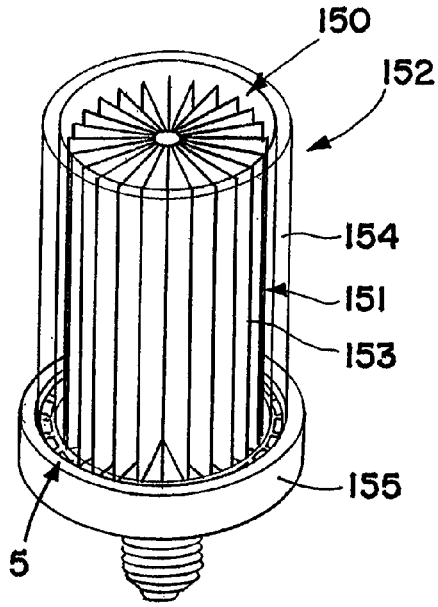

The internal heat sink 150 within the internal volume 151 of the light bulb embodiment 152 shown in FIG. 24 comprises radial fins 153 that extend radially outward from the longitudinal axis of the internal volume toward the inner surface of the light guide 154. The number and thickness of the fins are chosen such that there is sufficient space between the fins to provide a path for air flow and convective cooling through vents (not shown) in housing 155 and out the distal end of the light guide. In this and the other light bulb embodiments described herein, the direction of air flow is reversed when the light bulb is inverted.

Figure 27:
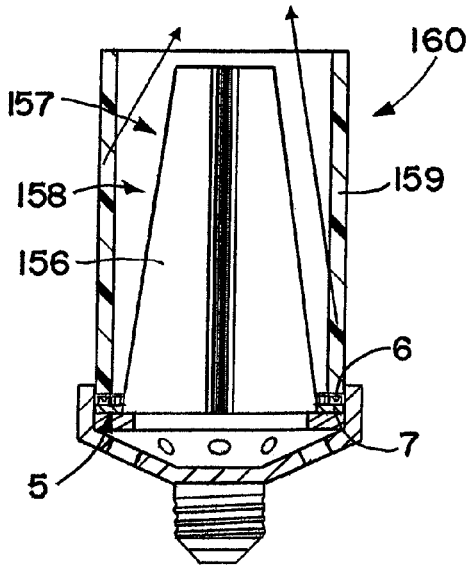

In the example shown in FIG. 24, the radial fins 153 extend outwardly to the same radial extent. Optionally, as shown in the light bulb embodiment 160 of FIG. 27, the radial fins 156 of the internal heat sink 157 within the internal volume 158 taper such that their radial dimension decreases with increasing distance from the proximal end of the light guide. The light ray angle distribution of the light emitted from the inner surface of the light guide 159 and the tapered shape of the fins 156 may be configured such that any obstruction of the emitted light by the fins is reduced, as schematically shown in FIG. 27. In general, for a particular light ray angle distribution of the emitted light, the shape or geometry of the fins may be chosen to minimize or reduce the obstruction of the emitted light by the fins.

Figure 30:
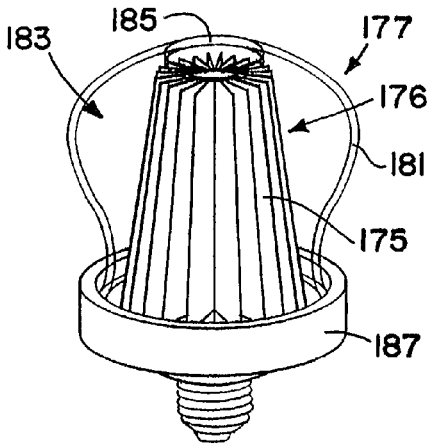
FIGS. 30 and 31 are schematic perspective views of other light bulb embodiments.
Figure 31:
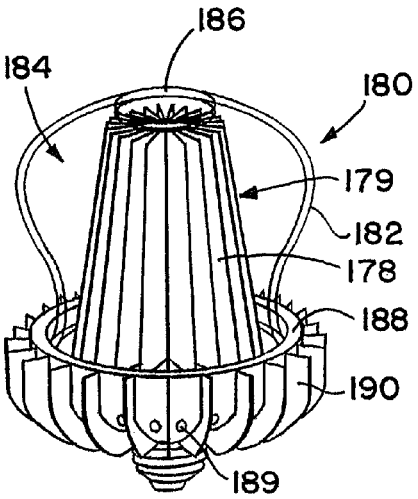
Figure 32:
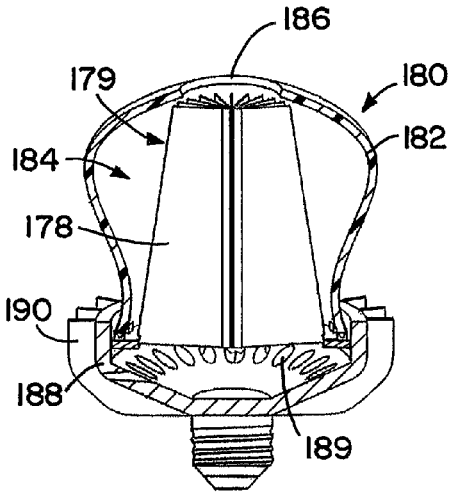
FIG. 32 is a schematic fragmentary longitudinal section through the light bulb embodiment of FIG. 31.

The fins 175 of the internal heat sink 176 of the example of the light bulb embodiment 177 of FIG. 30 and the fins 178 of the internal heat sink 179 of the example of the light bulb embodiment 180 of FIGS. 31 and 32 also taper with increasing distance from the proximal end of the respective light guides 181 and 182, similar to the tapered fins 156 of the FIG. 27 embodiment. However, the light guide 181 of the FIG. 30 embodiment and the light guide 182 of the FIGS. 31 and 32 embodiment, rather than having a uniform diameter throughout their length as in the FIG. 27 embodiment, have a diameter that varies along their length and form a generally closed hollow shape surrounding the respective internal volumes 183 and 184. The respective center vents 185 and 186 at the distal end of the respective light guides provide a path for air flow and convection cooling through vents in the respective housings 187 and 188 and the internal volumes. Vents 189 are shown in the housing 188 of light bulb embodiment 180 of FIGS. 31 and 32. Also the housing 188 of the FIGS. 31 and 32 embodiment comprises outer cooling fins 190 to increase the surface area of the housing, and, hence the ability of the housing 188 to dissipate heat.

Figure 25:
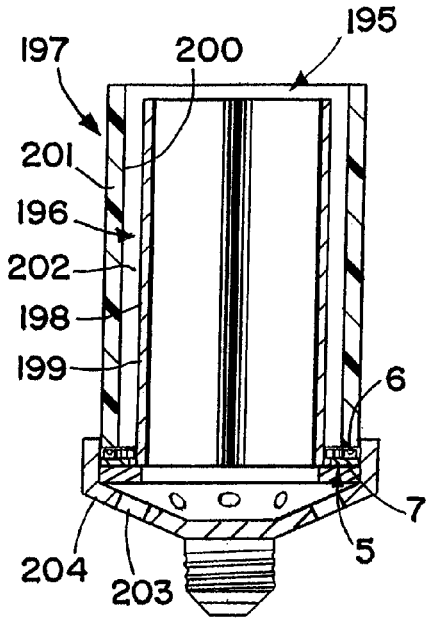
FIGS. 25-27 are schematic longitudinal sections through other light bulb embodiments.

In the example of the light bulb embodiment 197 shown in FIG. 25, the internal heat sink 195 within the internal volume 196 is substantially similar to the internal heat sink 150 of the FIG. 24 embodiment. However, the heat sink 195 of the FIG. 25 embodiment is shown contained within a heat sink enclosure 198 having an outer surface 199 facing the inner surface 200 of the light guide 201. In an example, the heat sink enclosure 198 is integral with the heat sink 150. In another example, the heat sink enclosure 198 and the heat sink 150 are separate components but are thermally coupled to one another. In another example, the heat sink enclosure 198 and the heat sink 150 are separate components but are not thermally coupled to one another. In the example shown, cooling air enters the light bulb through the vents 203, flows past the internal heat sink 150 and exits through the distal end of the light guide 201 to remove heat generated by the solid-state light source 5. Also, an air gap 202 between the heat sink enclosure 198 and the light guide 201 provides a path for additional cooling air to flow. However, other examples have no gap for additional cooling air, and the inner surface 200 of the light guide 201 is in contact with the outer surface 199 of the heat sink enclosure 198. Alternatively, the inner surface 200 is separated from the outer surface 199 by a gap insufficiently wide to provide a path for additional cooling air.

In the example shown, the outer surface 199 of heat sink enclosure 198 optionally includes optically-functional elements to impose additional optical effects on the light emitted from the inner surface of the light guide 201. The air gap 202 between the heat sink enclosure 198 and the light guide 201 provides a path for air flow and convective cooling through vents 203 in housing 204 and out the distal end of the light guide.

Figure 26:
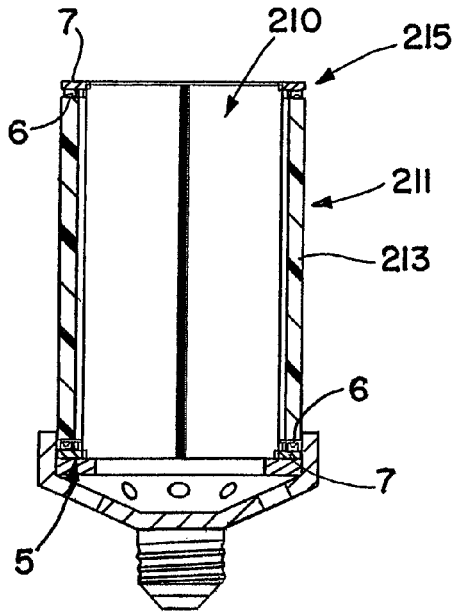

In the example of the light bulb embodiment 211 shown in FIG. 26, the internal heat sink 210 is substantially similar to the internal heat sink 150 of the FIG. 24 embodiment. However, in addition to solid-state light source 5 optically coupled to the proximal end of the light guide 213 as in other light bulb embodiments, an additional solid-state light source 215 is optically coupled to the distal end of the light guide 213 such that light from the solid-state light sources travels in opposite directions in the light guide by total internal reflection. In this example, both solid-state light sources 5 and 215 are thermally coupled to the internal heat sink 210 to help dissipate the heat generated by both light sources.

Also light-extracting optical elements are provided at least one of the outer surface and the inner surface of the light guide 213 for extracting light traveling in opposite directions in the light guide with a predetermined light ray angle distribution and/or intensity profile to increase the field of illumination and intensity of the light and to control the light ray angle distribution of the light output by the light bulb as desired to suit a particular application.

Figure 28:
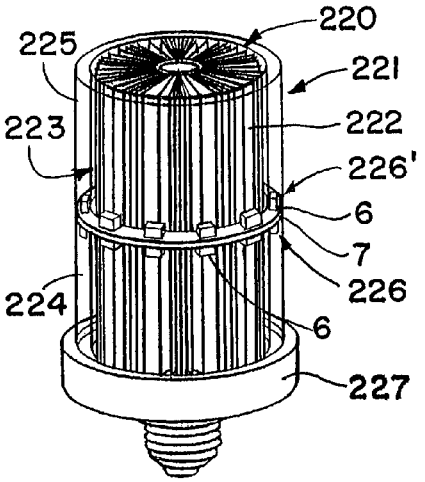
FIG. 28 is a schematic perspective view of another light bulb embodiment.
Figure 29:
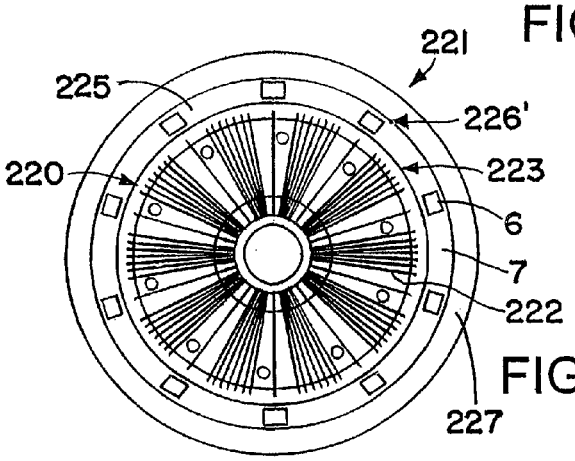
FIG. 29 is an enlarged schematic top plan view of the light bulb embodiment of FIG. 28.

In the example of the light bulb embodiment 221 shown in FIGS. 28 and 29, the internal heat sink 220 is substantially similar to the internal heat sink 150 of the FIG. 24 embodiment. However, the density of the fins 222 of the internal heat sink 220 of the FIGS. 28 and 29 embodiment is reduced at locations corresponding to the locations of the solid-state light emitters of the solid-state light source or light sources to provide greater air flow paths past the fins near the solid-state light emitters. Additionally, the density of the fins 222 may be varied so that there is a reduced fin density in areas corresponding to a peak in the emitted light intensity, to reduce obstruction of the emitted light by the fins. In an example, the light extracting optical elements at the interior surface of the light guide are configured so that the light is emitted from the inner surface of the light guide at low angles (less than 45 degrees) with respect to the inner surface of the light guide and with a majority of the light being emitted from the portion of the light guide surface that is along a line that extends from a solid-state light emitter toward the distal end of the light guide opposite that solid-state light emitter. This type of optical configuration causes the portion of the light emitted from the inner surface of the light guide to have a narrow light ray angle distribution with a peak intensity at a low ray angle relative to the inner surface of the light guide. In this example, the density of the fins is reduced in the areas along the path of peak light output in the line extending from a solid-state light emitter toward the distal end of the light guide opposite that solid-state light emitter to reduce the obstruction to the emitted light by the fins 222, as shown in FIG. 29.

Also, the internal volume 223 of the FIGS. 28 and 29 embodiment is surrounded by two (or more) light guides 224 and 225 each having proximal and distal ends. Light guides 224 and 225 are arranged in tandem with the proximal end of one of the light guides 225 separated from the distal end of the other light guide 224 by a gap.

One or more solid-state light sources are optically coupled to one or both ends of one or both light guides 224 and 225 for causing light to travel in one or both light guides in the same or different directions by total internal reflection. FIG. 28 shows two solid-state light sources 226 and 226' optically coupled to the adjacent ends of light guides 224 and 225. In other examples, additional solid-state light sources are optically coupled to one or both ends of one or both light guides. The solid-state light sources 226 and 226' are thermally coupled to the internal heat sink 220 part-way along the length of the heat sink 220. The heat sink 220 may additionally be used to supply electrical power to the solid-state light sources 226 and 226' from the housing 227. In another embodiment (not shown), additional light sources are located at the ends of the light guides 224 and 225 remote from the solid-state light sources 226 and 226'. The additional light sources are thermally coupled to the proximal end and the distal end, respectively, of the internal heat sink 220.

Alternatively, the solid-state light sources 226 and 226' may be molded into a single light guide (not shown), approximately half-way along the length of the light guide. The light guide may be similar to the combination of the light guides 224 and 225. The one or more printed circuit boards 6 that constitutes part of the solid-state light sources 226 and 226' extends radially inwards from the inside surface of the light guide to make thermal contact with the internal heat sink 220 and to receive electrical connections.

Figure 34:
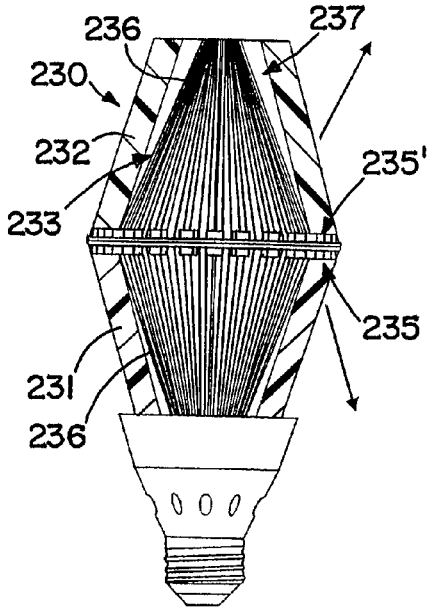
FIG. 34 is a schematic side view, partly in section, of another light bulb embodiment.

The example of the light bulb embodiment 230 shown in FIG. 34 also includes two light guides 231 and 232 arranged in tandem with their bases separated by a gap to form a generally hollow body surrounding the internal volume 233 similar to the light guides 224 and 225 of the FIGS. 28 and 29 embodiment. Also solid-state light sources 235 and 235' are shown optically coupled to the adjacent end edges of both light guides 231 and 232 in the FIG. 34 embodiment. Light from the solid-state light sources 235 and 235' travels in opposite directions in the respective light guides 231 and 232 by total internal reflection. However, the light guides of the FIG. 34 embodiment are frusto-conical in shape with a radius that decreases as a function of the distance away from the juxtaposed ends of the light guides. Also the fins 236 of the internal heat sink 237 of the FIG. 34 embodiment taper inwardly so that their radial dimension decreases with increasing distance from the juxtaposed ends of the respective light guides. Light-extracting optical elements are provided at least one of the outer surface and the inner surface of each of the light guides 231 and 232. The light-extracting optical elements are configured to extract light traveling in opposite directions in the light guides from the light guides with a predetermined light ray angle distribution and/or intensity profile in a manner similar to that described above to increase the field of illumination and intensity of the light and control the light ray angle distribution of the light output by the light bulb as desired to suit a particular application.

Figure 33:
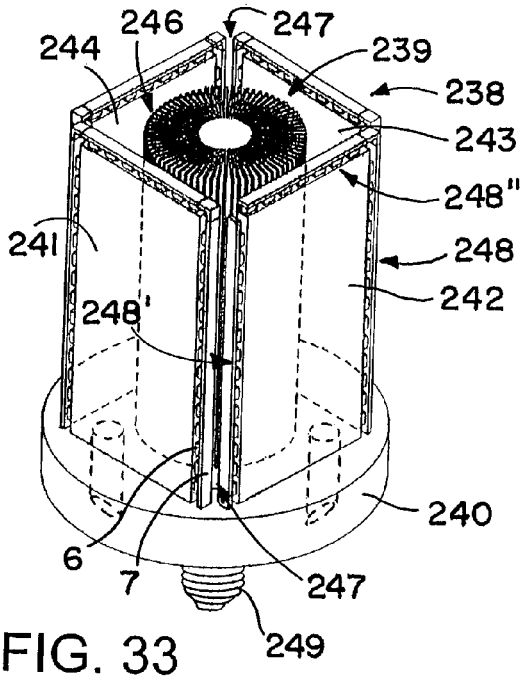
FIG. 33 is a schematic perspective view of another light bulb embodiment.

In the example of the light bulb embodiment 238 shown in FIG. 33, substantially planar light guide members 241-244 collectively form a light guide configured as a polygonal hollow body that surrounds the internal volume 246. Each light guide member corresponds to one side of the polygonal body. In addition, instead of solid-state light sources being located adjacent a proximal light input edge of each of the light guide members 241-244, as described above with reference to FIGS. 1*a*, 2 and 3, in the example shown in FIG. 33, solid-state light sources 248, 248' and 248" are optically coupled to one or more edges of each of the light guide members. Light from the solid-state light sources travels in different directions in each of the light guide members by total internal reflection. The internal heat sink 239 is substantially similar to the internal heat sink 150 of the FIG. 24 embodiment, and is thermally coupled to the housing 240 at the proximal end of the light guide members to increase the ability of the light bulb to dissipate the heat produced by the solid-state light sources. Additionally, gaps 247 are provided between adjacent side edges of adjacent ones of the light guides to allow for air flow through the gaps.

In the example shown in FIG. 33, solid-state light sources 248, 248' and 248" are optically coupled to the opposite side edges and the distal end edge of each of the light guides 241-244. The proximal ends of the circuit boards of the respective solid-state light sources extending along the side edges of the light guides are electrically coupled to an electrical connection 249 mounted on the housing 240 for supplying electrical power to the solid-state light sources. Light-extracting optical elements are provided at least one of the outer surface and the inner surface of each of the light guides. The light-extracting optical elements are configured to extract light, traveling in different directions in each of the light guides, from the light guides with a predetermined light ray angle distribution and/or intensity profile in the manner described above to increase the field of illumination and intensity of the light and control the light ray angle distribution of the light emitted from the light bulb as desired to suit a particular application.

Figure 35:
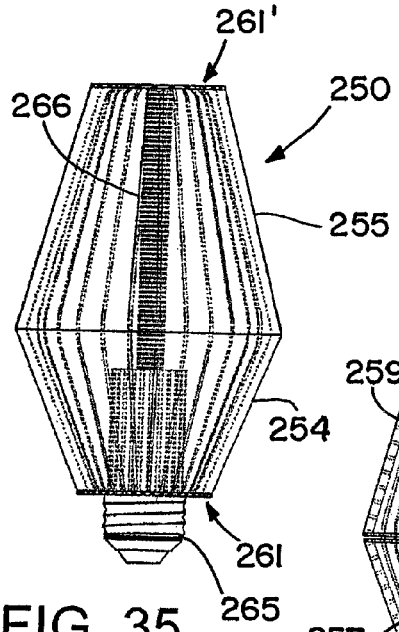
FIGS. 35-37 are schematic side views of other light bulb embodiments.
Figure 36:
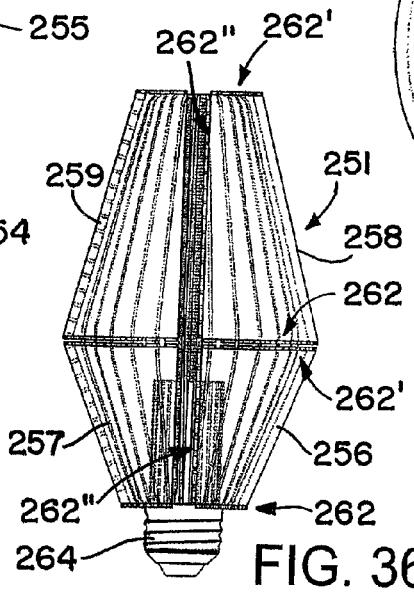
Figure 37:
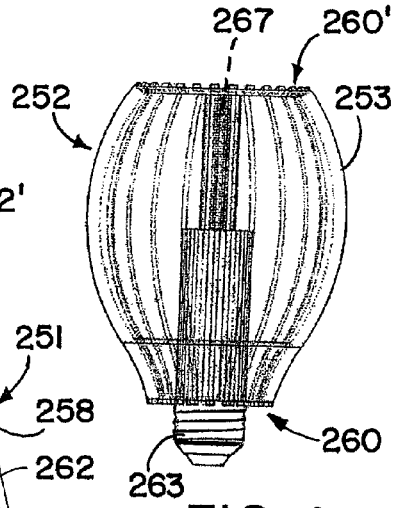

FIGS. 35-37 show examples of other light bulb embodiments 250-252 comprising one or more non-planar light guides that form a hollow polygonal body that surrounds the internal volume. The radial dimension of the polygonal body varies as a function of distance away from the proximal end and/or the proximal and distal ends of the light guide members.

In the example shown in FIG. 37, a single non-planar light guide 253 is configured as the polygonal body surrounding the internal volume. In the example shown in FIG. 35, two non-planar light guides 254 and 255 are arranged in tandem to form the polygonal body surrounding the internal volume. In the example shown in FIG. 36, four non-planar light guides 256-259 form the polygonal body surrounding the internal volume. Also in each of these examples, solid-state light sources are optically coupled to one or more edges of the light guides. Light from the solid-state light sources travels in the light guides in different directions by total internal reflection. In FIG. 37, solid-state light sources 260 and 260' are optically coupled to both end edges of the light guide 253; in FIG. 35, solid-state light sources 261 and 261' are optically coupled to the proximal end edge of light guide 254 and the distal end edge of light guide 255; and in FIG. 36, solid-state light sources 262, 262' and 262" are optically coupled to the proximal and distal end edges and the side edges of each of the light guides.

Moreover, in all three of these examples, an electrical connection 263-265 at the proximal end of the respective light bulb is electrically coupled to the solid-state light sources at that end. Also at least in the FIGS. 35 and 37 examples, electrical conduits 266 and 267 extend from the electrical connections into the internal volumes and are electrically coupled to the other solid-state light sources 261' and 260'. Light-extracting optical elements are provided at least one of the outer surface and the inner surface of the respective light guides of each of these examples. The light-extracting optical elements are configured to extract light traveling in different directions in the light guides from the light guide with a predetermined light ray angle distribution and/or intensity profile in the manner previously described.

Figure 38:
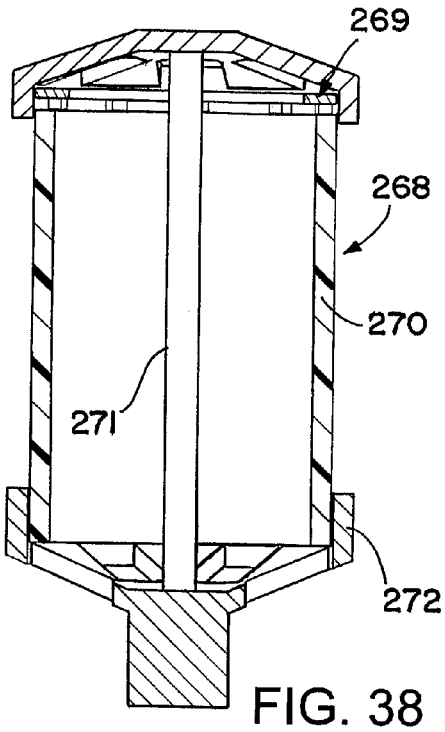
FIG. 38 is a schematic longitudinal section through another light bulb embodiment.

FIG. 38 shows an example of another light bulb embodiment 268 that is similar to the embodiment shown in FIGS. 1*a*, 2 and 3 except that a solid-state light source 269 is optically coupled to the distal end of the light guide 270 and the solid-state light source is electrically connected by an electrical conduit 271 to the housing 272 for supplying electrical power to the solid-state light source.

Figure 39:
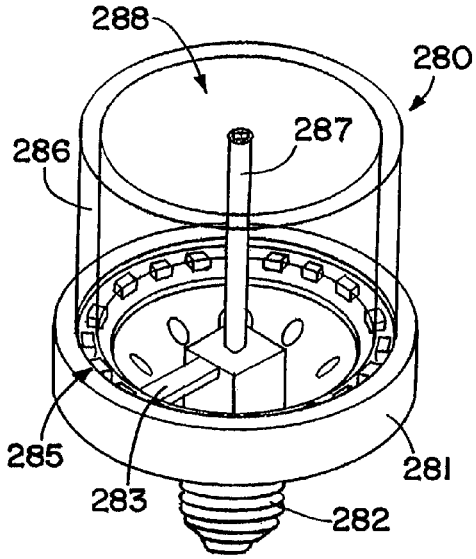
FIGS. 39-41 are schematic perspective views of modular light bulb embodiments.

FIG. 39 shows an example of a modular light bulb component 280 comprising a housing 281 having a main electrical connection 282 for supplying electrical power to the housing and one or more electrical conduits of any desired length for bringing electrical power and/or connections from the main electrical connection to one or more solid-state light sources or other electrical components located at different distances away from the main electrical connection.

In FIG. 39, an electrical conduit 283 is shown for supplying electrical power to a solid-state light source 285 positioned within the housing 281 and optically coupled to the light input edge at the proximal end of the light guide 286. Light output by solid-state light source 285 in response to the supplied electrical power travels in the light guide 286 by total internal reflection.

Figure 40:
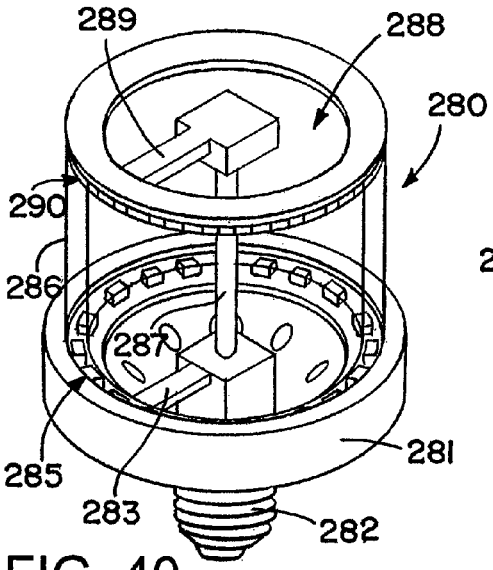
Figure 41:
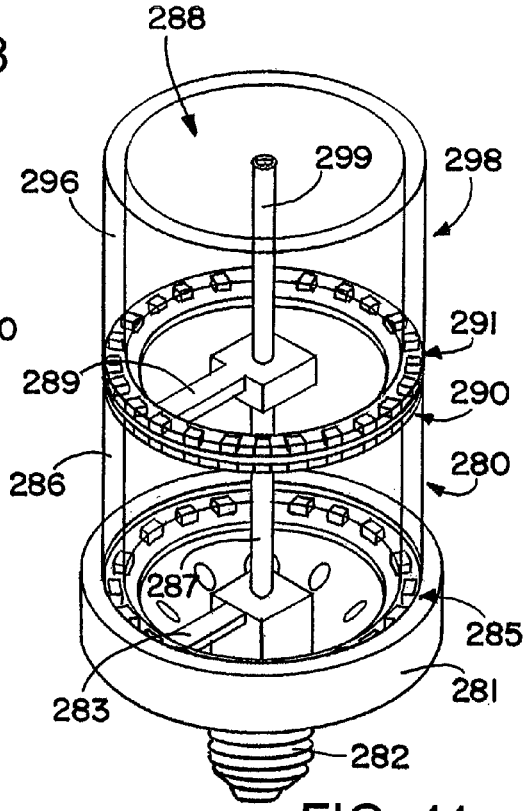
Figure 42:
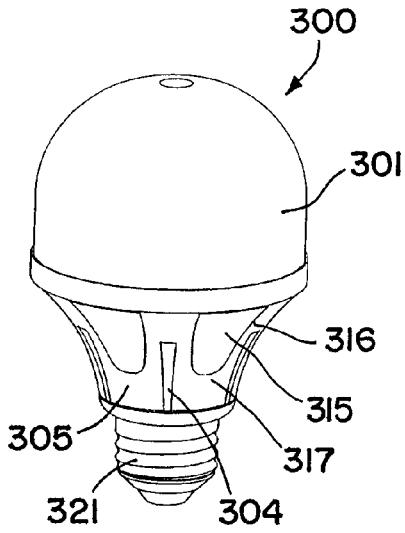
FIG. 42 is a schematic perspective view of another light bulb embodiment.
Figure 43:
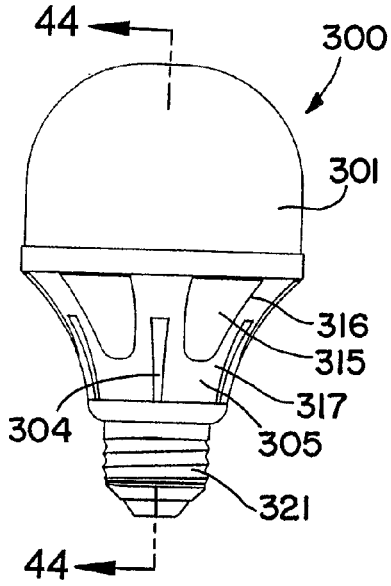
FIG. 43 is a schematic side view of the light bulb embodiment of FIG. 42 in line with a vent in the light bulb housing.
Figure 44:
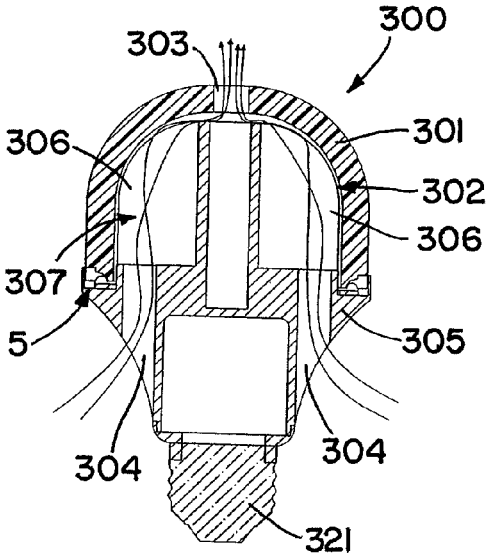
FIG. 44 is a schematic longitudinal section through the light bulb of FIG. 43, taken on the plane of the line 44-44 thereof.
Figure 45:
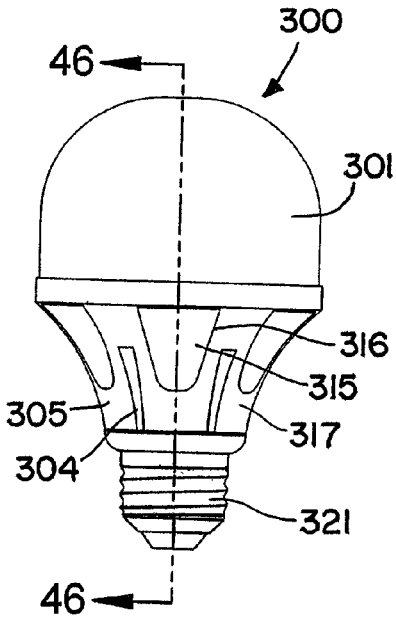
FIG. 45 is a schematic side view of the light bulb of FIG. 42 in line with an auxiliary light guide on the outer surface of the light bulb housing.
Figure 46:
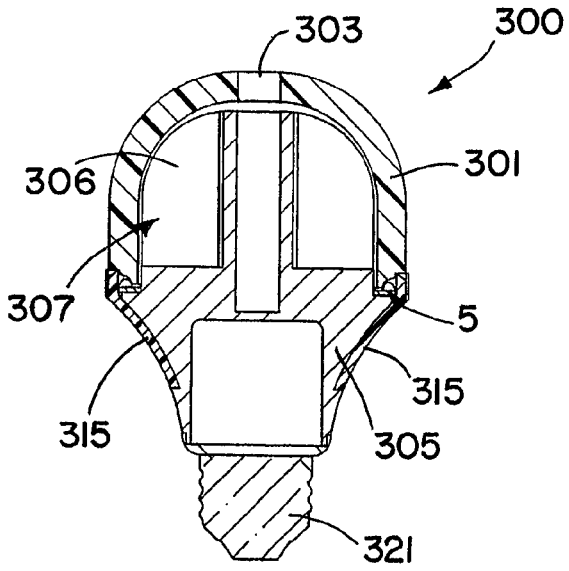
FIG. 46 is a schematic longitudinal section through the light bulb of FIG. 45, taken on the plane of the line 46-46 thereof.
Figure 47:
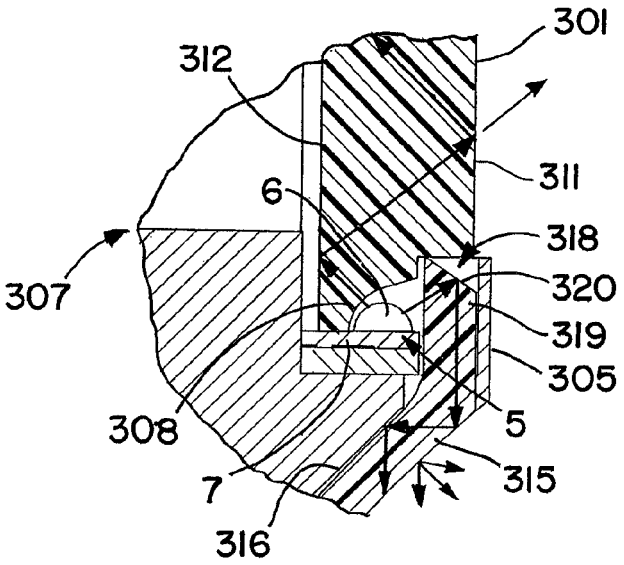
FIG. 47 is an enlarged fragmentary longitudinal section of a portion of the light bulb of FIG. 46.

A second electrical conduit 287 of any desired length is shown extending in the internal volume 288 of the modular light bulb component 280 for supplying electrical power, for example, through another electrical conduit 289 to a second solid-state light source 290 optically coupled to the light input edge at the distal end of the light guide 286 as shown in FIG. 40, and/or to a solid-state light source 291 optically coupled to the light input edge at the proximal end of the light guide 296 of another modular light bulb 298 arranged in tandem with the modular light bulb 280 at the distal end thereof, as shown in FIG. 41. In like manner, additional electrical conduits 299 of any desired length may be electrically coupled to electrical conduit 287 and extend in the internal volume 288 for bringing electrical power to different locations along the overall length of the light bulb where the light bulb is comprised of additional modular components each requiring power, and/or to provide electrical power to different locations for a variety of sensors that may be part of the light bulb.

Such electrical conduits allow the light bulb to be extended to any desired length, and also provide for configurable brightness levels by allowing the addition of other solid-state light sources in a modular manner. In addition, such electrical conduits do not require the light guides to be changed or to be made smaller so that the maximum area is available for the light guides and associated solid-state light sources of the light bulb to promote the brightest light bulb design possible. For example, while the illustrated light guides are configured as hollow cylindrical bodies surrounding the internal volume, the light guides may be configured as hollow bodies having other shapes and surrounding respective internal volumes, including hollow bodies having a polygonal cross-sectional shape or hollow bodies having an elliptical cross-sectional shape. Such cross-sectional shapes are in a plane parallel to the light input edge of the light guide. Also, light guides may be assembled together to form the hollow bodies surrounding the internal volumes. Moreover, the radial dimension or diameter of the light guides may vary as a function of the distance away from the proximal end or distal end of the light guides. Additionally, the electrical conduits may function as a heat sink within the internal volumes. To increase their effectiveness as heat sinks, the electrical conduits may have fins extending radially outward therefrom in a manner similar to that shown in FIG. 24. The fins may be integral with the conduit or may be separate components attached to the conduit. Light-extracting optical elements are provided at least one of the outer surface and the inner surface of the light guides. The light-extracting optical elements are configured to extract light from the light guides in the manner described above.

FIGS. 42-47 show an example of another light bulb embodiment 300. In the example of the light bulb embodiment 300 shown in FIGS. 42-47, the light guide 301 has a radius that varies along its length and forms a generally closed hollow dome shape surrounding an internal volume 302. A center vent 303 is located at the distal end of the light guide to provide a path for air flow and convection cooling through vents 304 in the housing 305 and between the radial fins 306 of internal heat sink 307 within the internal volume (see FIG.

44), similar to the light bulb embodiments shown in FIGS. 30-32. A solid-state light source 5 is optically coupled to a light input edge 308 at the proximal end of the light guide 301 (see FIG. 47) for causing light to travel in the light guide by total internal reflection. Light-extracting optical elements are provided at least one of the outer surface 311 and the inner surface 312 of the light guide 301. The light-extracting optical elements are configured to extract light traveling in the light guide from the light guide in the manner previously described.

The light bulb embodiment 300 shown in FIGS. 42-47 additionally includes at least one auxiliary light guide 315 that captures a portion of the light emitted by the solid-state light source 5. The captured light travels in the auxiliary light guide 315 by total internal reflection. In the example shown in FIGS. 42-47, circumferentially spaced auxiliary light guides 315 extend along recesses 316 in the outer surface 317 of the housing 305 intermediate circumferentially spaced vents 304 in the housing. The light input edge 308 of the light guide 301 is configured to capture a first portion of the light emitted from the solid state light source. A second portion (typically the remainder) of the light emitted from the solid state light source is incident on the distal end 319 of the auxiliary light guides 315 and enters the auxiliary light guides (see FIG. 47). Circumferentially-spaced regions 318 are provided at the light input edge 308 of the light guide 301 radially outwardly of the solid-state light source 5 into which the distal ends 319 of the respective auxiliary light guides 315 extend.

The auxiliary light guides 315 each have an optical coupling feature for directing the captured light into the auxiliary light guides. The captured light then propagates along the auxiliary light guide by total internal reflection. In some embodiments, the optical coupling feature guides the captured light by total internal reflection. In other embodiments, the optical coupling feature guides the captured light by reflection at least one reflective surface. In the example auxiliary light guide 315 shown in FIG. 47, the distal end 319 of the auxiliary light guide 315 has a slanted surface 320 that redirects the captured light into the auxiliary light guide 315 so that the captured light travels in the auxiliary light guide by total internal reflection. Examples of other optical coupling features that can be used to redirect the captured light to travel into the auxiliary light guides so that the captured light travels in the auxiliary light guides by total internal reflection are curved surfaces, one or more notched surfaces, or other light redirecting optics. Light-extracting optical elements (not shown) are provided at least one of the inner surface and the outer surface of the auxiliary light guides. The light-extracting optical elements are configured to extract at least a portion of the light traveling in the auxiliary light guides from the auxiliary light guides. The extracted light is emitted from the outer surfaces of the auxiliary light guides.

Each of light bulb embodiments described has at least one light guide through which light from a solid-state light source propagates by total internal reflection at the opposed major surfaces of the light guide. Referring again to FIG. 3 as an example, the length and width dimensions of each of the surfaces 17, 18 of the light guide 2 are much greater than, typically ten or more times greater than, the thickness of the light guide 2. The length (measured from the light input edge 4 to an opposite edge distal the light input edge 4) and the width (measured along the light input edge 4) of the light guide 2 are both much greater than the thickness of the light guide 2. The thickness is the dimension of the light guide 2 in the radial direction. The thickness of the light guide 2 may be, for example, about 0.1 millimeters (mm) to about 10 mm. The light guide 2 may be rigid or flexible.

Light-extracting optical elements (not shown) are located in one or more defined areas of at least one of the inner surface 17 and the outer surface 18 of light guide 2. The light-extracting optical elements are configured to extract light propagating through the light guide 2 from the light guide with a predetermined light ray angle distribution and/or intensity profile. The light extracting optical elements function to disrupt the total internal reflection of the light that propagates through the light guide 2 and is incident on the light extracting optical elements. In some embodiments, the light extracting optical elements at the inner surface 17 of the light guide reflect light toward the outer surface 18 of the light guide and the light exits the light guide through the outer surface 18 and/or vice versa. In other embodiments, the light extracting optical elements at the inner surface 17 of the light guide transmit light so that the light exits the light guide through the inner surface 17 and/or vice versa. In other embodiments, both of these types of light extracting optical elements are present. In yet other embodiments, the light extracting optical elements reflect some of the light and refract the remainder of the light incident thereon. The light extracting elements are configured to extract light from one or both of the surfaces 17, 18.

The light guides disclosed herein, such as the light guide 2 shown in FIG. 3, having light extracting optical elements at one or more of its surfaces are typically formed by a process such as stamping, molding, embossing, extruding, laser etching, chemical etching, or another suitable process. Light extracting optical elements may also be produced by depositing elements of curable material on the light guide 2 and curing the deposited material using heat, UV-light or other radiation. The curable material can be deposited by a process such as printing, ink jet printing, screen printing, or another suitable process. Alternatively, the light extracting elements may be inside the light guide 2 between the inner and outer surfaces 17, 18 (e.g., the light extracting optical elements may be light redirecting particles and/or voids disposed in the light guide).

Exemplary light extracting optical elements include light-scattering elements, which are typically features of indistinct shape or surface texture, such as printed features, ink-jet printed features, selectively-deposited features, chemically etched features, laser etched features, and so forth. Other exemplary light extracting optical elements include features of well-defined shape, such as V-grooves, lenticular grooves, and features of well-defined shape that are small relative to the linear dimensions of the surfaces 17, 18, which are sometimes referred to as micro-optical elements. The smaller of the length and width of a micro-optical element is less than one-tenth of the longer of the length and width of the light guide 2, and the larger of the length and width of the micro-optical element is less than one-half of the smaller of the length and width of the light guide. The length and width of the micro-optical element is measured in a plane parallel to the surface of the light guide for flat light guides or along a surface contour for non-flat light guides such as light guide 2.

Micro-optical elements are shaped to predictably reflect light or predictably refract light. However, one or more of the surfaces of the micro-optical elements may be modified, such as roughened, to produce a secondary effect on light output. Exemplary micro-optical elements are described in U.S. Pat. No. 6,752,505 and, for the sake of brevity, will not be described in detail in this disclosure. The micro-optical elements may vary in one or more of size, shape, depth or height, density, orientation, slope angle, or index of refraction such that a desired light output from the light guide 2 is achieved.

In this disclosure, the phrase "one of" followed by a list is intended to mean the elements of the list in the alternative. For example, "one of A, B and C" means A or B or C. The phrase "at least one of" followed by a list is intended to mean one or more of the elements of the list in the alternative. For example, "at least one of A, B and C" means A or B or C or (A and B) or (A and C) or (B and C) or (A and B and C).

Although this disclosure has described certain embodiments, equivalent alterations and modifications will become apparent upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the disclosed component which performs the function of the herein disclosed exemplary embodiments. In addition, while a particular feature may have been disclosed with respect to only one embodiment, such feature may be combined with one or more other features as may be desired and advantageous for any given or particular application.

What is claimed is:

1. A light bulb comprising: a first light guide configured as a hollow body surrounding an internal volume, the first light guide being open at a proximal end and a distal end, opposite the proximal end, and comprising an inner surface, an outer surface and an end surface at the proximal end that provides a light input edge; a solid-state light source optically coupled to the light input edge such that light from the solid-state light source travels in the light guide by total internal reflection; a housing at the proximal end of the light guide, the solid-state light source being thermally coupled to the housing, the housing defining vents for air flow and convection cooling through the internal volume; and light-extracting optical elements at least one of the inner surface and the outer surface of the light guide for extracting light from the light guide; and a second light guide comprising an inner surface facing toward the internal volume; wherein the second light guide is configured as a hollow body surrounding the internal volume, the second light guide being open at a proximal end and a distal end, opposite the proximal end, the second light guide comprises an outer surface and an end surface at the proximal end of the second light guide that provides a light input edge, wherein one of the light guides is positioned in the other light guide with an air gap between the light guides; a second solid-state light source is optically coupled to the light input edge of the second light guide such that light from the second solid-state light source travels in the second light guide by total internal reflection, the second solid-state light source being thermally coupled to the housing; and additional light-extracting optical elements are at least one of the inner surface and the outer surface of the second light guide to extract light from the second light guide.

2. The light bulb of claim 1 wherein the housing comprises fins to increase the surface area of the housing.

3. The light bulb of claim 1 wherein: an electrical conduit extends within the internal volume for supplying power to the second solid-state light source.

4. The light bulb of claim 3 further comprising a third solid-state light source optically coupled to the distal end of the first light guide, the third solid-state light source receiving power from the electrical conduit.

5. The light bulb of claim 1 wherein: the second light guide is positioned in the first light guide with an air gap between the first and second light guides, the second light guide comprising an outer surface facing away from the internal volume, a proximal end and a distal end, the distal end forming an opening of the internal volume.

6. The light bulb of claim 1 wherein the light-extracting optical elements provided at the at least one of the surfaces of the first light guide are configured to produce a desired light ray angle distribution and/or intensity profile from the first light guide.

7. A light bulb comprising:

a light guide configured as a hollow body surrounding an internal volume, the light guide being open at a proximal end and a distal end, opposite the proximal end, and comprising an inner surface, an outer surface and an end surface at the proximal end that provides a light input edge;

a solid-state light source optically coupled to the light input edge such that light from the solid-state light source travels in the light guide by total internal reflection;

a housing at the proximal end of the light guide, the solid-state light source being thermally coupled to the housing, the housing defining vents for air flow and convection cooling through the internal volume;

light-extracting optical elements at at least one of the inner surface and the outer surface of the light guide for extracting light from the light guide; and an auxiliary light guide, the auxiliary light guide being configured to capture a portion of the light emitted by the solid-state light source, the auxiliary light guide comprising an optical coupling feature for causing the captured light to travel in the auxiliary light guide by total internal reflection, and light-extracting optical elements for extracting light from the auxiliary light guide.

8. The light bulb of claim 7 further comprising a region adjacent the light input edge of the light guide through which the portion of the light emitted by the solid-state light source enters the auxiliary light guide.

9. The light bulb of claim 7 further comprising a recess in the housing in which the auxiliary light guide extends.

10. A light bulb having an internal volume, the light bulb comprising:

a first light guide comprising an inner surface facing toward the internal volume, an outer surface facing away from the internal volume, a proximal end and a distal end, opposite the proximal end, the distal end forming an opening of the internal volume;

a first solid-state light source;

a housing adjacent the proximal end of the first light guide for locating the first solid-state light source relative to the proximal end such that light from the first solid-state light source travels in the first light guide by total internal reflection, the first solid-state light source being thermally coupled to the housing;

light-extracting optical elements at at least one of the surfaces of the first light guide to extract light from at least one of the surfaces of the first light guide; and a second solid-state light source optically coupled to the first light guide in an axially-spaced relation to the first solid-state light source such that light from the solid-state light sources enters the first light guide at different axially spaced locations and travels in the first light guide in the same or different directions by total internal reflection.

11. The light bulb of claim 10 wherein:

the second solid-state light source is optically coupled to the first light guide intermediate the proximal end and the distal end, and an electrical conduit extends within the internal volume to provide power to the second solid-state light source.

12. The light bulb of claim 10, wherein:

the second solid-state light source is optically coupled to the distal end of the first light guide, and an electrical conduit extends within the internal volume to provide power to the second solid-state light source.

13. A light bulb having an internal volume, the light bulb comprising:

a light guide comprising an inner surface facing toward the internal volume, an outer surface facing away from the internal volume, a proximal end and a distal end, opposite the proximal end, the distal end forming an opening of the internal volume;

a solid-state light source;

a housing adjacent the proximal end of the light guide for locating the solid-state light source relative to the proximal end such that light from the solid-state light source travels in the light guide by total internal reflection, the solid-state light source being thermally coupled to the housing; and light-extracting optical elements at at least one of the surfaces of the light guide to extract light from at least one of the surfaces of the light guide; wherein the light-extracting optical elements differ in at least one of type and shape within selected areas of the at least one of the surfaces of the light guide to provide a broad light ray angle distribution of extracted light and a narrower light ray angle distribution of extracted light from respective selected areas of the light guide.

14. The light bulb of claim 13 wherein the distal end of the first light guide has an optical end feature.

15. The light bulb of claim 14 wherein the optical end feature comprises one or more of: a flat end feature, a V-groove, a lenticular groove, a bulbous end feature, a bullnose feature, a light reflecting feature, a light absorbing feature, a color attenuator, a wavelength-shifter, and an anti-reflective feature.

16. A light bulb having an internal volume, the light bulb comprising:

a first light guide comprising an inner surface facing toward the internal volume, an outer surface facing away from the internal volume, a proximal end and a distal end, opposite the proximal end, the distal end defining an opening of the internal volume;

solid-state light sources optically coupled to the first light guide such that light from the solid-state light sources enters the first light guide and travels in the first light guide by total internal reflection;

light-extracting optical elements at at least one of the surfaces of the first light guide to cause light to be emitted from at least one of the surfaces in a predetermined light ray angle distribution;

an electrical connection for supplying electrical power to the solid-state light sources;

an internal heat sink within the internal volume, the solid-state light sources being thermally coupled to the heat sink; and a second light guide comprising an inner surface facing toward the internal volume.

17. The light bulb of claim 16 wherein at least one of the solid-state light sources is optically coupled to the first light guide intermediate the proximal and distal ends of the first light guide.

18. The light bulb of claim 16, wherein:

the second light guide comprises an outer surface facing away from the internal volume, a proximal end, and a distal end, opposite the proximal end, the proximal end of the second light guide being positioned adjacent the distal end of the first light guide; and at least one of the solid-state light sources is optically coupled to the second light guide such that the light from the one of the solid-state light sources enters the second light guide and travels in the second light guide by total internal reflection.

19. The light bulb of claim 18 additionally comprising:

a first electrical conduit extending from the electrical connection within the internal volume surrounded by the first light guide; and a second electrical conduit connected to the first electrical conduit and extending within the internal volume surrounded by the second light guide to provide an electrical connection to the one of the solid-state light sources optically coupled to the second light guide.

20. The light bulb of claim 19 wherein one of the solid-state light sources is optically coupled to the proximal end of the first light guide, and another one of the solid-state light sources is optically coupled to the proximal end of the second light guide.

21. The light bulb of claim 19 wherein one of the solid-state light sources is optically coupled to the distal end of the first light guide, and another one of the solid-state light sources is optically coupled to the proximal end of the second light guide.

22. The light bulb of claim 16 additionally comprising a heat sink enclosure surrounding the internal heat sink, the heat sink enclosure having an exterior surface facing toward the inner surface of the first light guide.

23. The light bulb of claim 22 wherein the exterior surface of the heat sink enclosure comprises optically functional elements.

24. The light bulb of claim 23 wherein the optically functional elements are selected from a group consisting of micro-optical elements, V-grooves, lenticular grooves, diffuse reflectors, specular reflectors, metals, light absorbers, color attenuators, wavelength-shifters, dielectric stack reflectors, polarizers and transreflectors.

25. A light bulb comprising:

a light guide configured as a hollow body surrounding an internal volume, the light guide having an inner surface facing toward the internal volume and an outer surface facing away from the internal volume, and comprising a proximal end and a distal end, opposite the proximal end, the light guide being open at the distal end;

solid-state light sources optically coupled to the proximal end such that light from the solid-state light sources travels in the light guide by total internal reflection;

light-extracting optical elements at at least one of the inner surface and the outer surface of the light guide for extracting light from the light guide; wherein the light-extracting optical elements are at both the inner surface and the outer surface of the light guide, and the light-extracting optical elements are configured to produce different light output distributions from the respective inner surface and outer surface of the light guide.

26. The light bulb of claim 25 wherein the light guide comprises light guide members assembled together to form the light guide, and the light guide members have a radial dimension that varies as a function of distance away from the proximal end or the distal end.

27. The light bulb of claim 25 wherein the light guide comprises light guide members assembled together to form the light guide, and the light guide members form a polygonal hollow body surrounding the internal volume.

28. The light bulb of claim 27 additionally comprising air gaps between edges of adjacent ones of the light guide members to allow for air flow through the air gaps.

29. The light bulb of claim 28 wherein solid-state light sources are optically coupled to the edges of the adjacent ones of the light guide members.

30. The light bulb of claim 25 wherein the light guide has a substantially constant cross section over its length.

31. The light bulb of claim 25 wherein the light guide has a cross section that varies over its length.

32. The light bulb of claim 25 wherein the light guide comprises multiple layers.

33. The light bulb of claim 25 wherein the light-extracting optical elements are configured such that the light output distribution from one of the surfaces is more directional than the light output distribution from the other surface.

34. The light bulb of claim 25 wherein the light-extracting optical elements are configured such that the light output distribution from one of the surfaces is more diffusive than the light output distribution from the other surface.

35. The light bulb of claim 25 wherein the light guide comprises multiple sections.

36. The light bulb of claim 35 wherein the multiple sections are bonded together.

37. The light bulb of claim 35 wherein the multiple sections are not bonded together.

38. The light bulb of claim 25 wherein the light guide comprises a single material.

39. The light bulb of claim 25 wherein at least some of the solid-state light sources vary in color.

40. The light bulb of claim 25 further comprising a plate or film positioned to cover the distal end of the light guide.

41. The light bulb of claim 40 wherein the plate or film is substantially flat.

42. The light bulb of claim 40 wherein the plate or film is dome shaped.

43. The light bulb of claim 25 wherein the light-extracting optical elements are at selective areas only of at least one of the surfaces of the light guide.

44. The light bulb of claim 43 wherein the light-extracting optical elements at the selective areas are of different types.

45. The light bulb of claim 25 wherein the light guide is a blow molded light guide.

46. The light bulb of claim 40 wherein the film or plate has optical elements.

47. The light bulb of claim 25 further comprising an end cap adjacent the distal end of the light guide.

48. The light bulb of claim 47 wherein the end cap at least partially closes the distal end of the light guide.

49. The light bulb of claim 47 wherein the end cap comprises a lens.

50. The light bulb of claim 47 wherein the end cap comprises a focusing region.

51. The light bulb of claim 47 wherein the end cap comprises an optical insert.

52. The light bulb of claim 51 further comprising an optical sensor positioned within the internal volume.

53. The light bulb of claim 52 wherein the optical insert comprises a focusing region configured to focus light originating outside the light bulb onto the optical sensor.

54. The light bulb of claim 53 wherein the optical sensor comprises an image sensor, photodiode, photoresistor or motion sensor.

55. The light bulb of claim 51 wherein the optical insert comprises a lens, reflector, or diffuser.

56. The light bulb of claim 51 wherein the optical insert comprises one or more of: a micro-optical element, a V-groove, a lenticular groove, a diffuse reflector, a specular reflector, a metal surface, a light absorber, a color attenuator, a wavelength shifter, a dielectric stack reflector, a polarizer and a transreflector.

57. The light bulb of claim 51 wherein the optical insert comprises an extension that extends at least partway into the internal volume.

58. The light bulb of claim 57 wherein the extension of the optical insert occupies a substantial portion of the internal volume.

59. The light bulb of claim 57 additionally comprising an air gap between the extension and the inner surface of the first light guide.

60. The light bulb of claim 51 wherein at least a portion of the light is emitted from the inner surface of the first light guide, and the optical insert is configured to redirect light emitted from the inner surface.

* * * * *